US007667414B2

(12) United States Patent
Fujino et al.

(10) Patent No.: US 7,667,414 B2
(45) Date of Patent: Feb. 23, 2010

(54) LED LIGHTING APPARATUS

(75) Inventors: Takashi Fujino, Tokyo (JP); Shigeru Murata, Tokyo (JP); Kazuaki Ashinuma, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 177 days.

(21) Appl. No.: 11/746,768

(22) Filed: May 10, 2007

(65) Prior Publication Data

US 2007/0273306 A1 Nov. 29, 2007

(30) Foreign Application Priority Data

May 24, 2006 (JP) ..... 2006-144408
May 24, 2006 (JP) ..... 2006-144411

(51) Int. Cl.
*H05B 37/02* (2006.01)

(52) U.S. Cl. ..... 315/307; 315/219; 315/224; 315/308

(58) Field of Classification Search ..... 315/307, 315/308, 219, 224; 345/83
See application file for complete search history.

(56) References Cited

U.S. PATENT DOCUMENTS

2005/0093792 A1 5/2005 Yamamoto et al.
2007/0267984 A1* 11/2007 Peng ..... 315/312

FOREIGN PATENT DOCUMENTS

JP 2005136157 5/2005

* cited by examiner

*Primary Examiner*—David Hung Vu
(74) *Attorney, Agent, or Firm*—Cermak Kenealy Vaidya & Nakajima LLP

(57) ABSTRACT

An LED lighting apparatus can be configured to supply a number of LEDs connected in series with a requisite voltage and power even if an amount of forward voltage of the LEDs connected in series is larger than a supply voltage of a battery. The LED lighting apparatus can include a boosting circuit and an inverted boosting circuit. LEDs can be connected between outputs of the boosting circuit and the inverted boosting circuit. The LED lighting apparatus can also include a current detection circuit configured to detect an LED current, and can include a dual PWM control IC configured to control the boosting circuit and the inverted boosting circuit in accordance with the LED current detected by the current detection circuit so as to keep the LED current substantially constant. The LED lighting apparatus can include a shutdown circuit to stop supplying a power supply when a load that includes the LEDs is in a circuit that is either opened or shorted.

7 Claims, 4 Drawing Sheets

LED LIGHTING APPARATUS

This application claims the priority benefit under 35 U.S.C. §119 of Japanese Patent Application No. 2006-144408 filed on May 24, 2006 and Japanese Patent Application No. 2006-144411 filed on May 24, 2006, both of which are hereby incorporated in their entireties by reference.

BACKGROUND

1. Field

The presently disclosed subject matter relates to a LED lighting apparatus for lighting LEDs. More specifically, the subject matter relates to a LED lighting apparatus in which an amount of forward voltage for LEDs connected in series is larger than a supply voltage of a battery. The LED lighting apparatus can be used whenever a number of LEDs are used, such as in a vehicular lamp (e.g., tail-lights, stop lights, signal lights, headlights, etc.).

2. Description of the Related Art

FIG. 2 shows a conventional LED lighting apparatus 90 in which a plurality of LEDs 80 are connected in series and lit by use of a battery supply voltage that is lower than an amount of forward voltage of the LEDs 80. The conventional LED lighting apparatus 90 includes: a control circuit 91; a boosting circuit 92 controlled by the control circuit 91; an inverted boosting circuit 93 configured by using a charge pump circuit, and operated by the control circuit 91; wherein the LEDs 80 are connected between an output of the boosting circuit 92 and an output of the inverted boosting circuit 93 through a constant current circuit 96, if necessary. The conventional LED lighting apparatus 90 can light a requisite number of LEDs when a predetermined output voltage is supplied between the output of the boosting circuit 92 and the output of the inverted boosting circuit 93.

The control circuit 91 can control the predetermined output voltage by feeding back a voltage divided between resistors 94 and 95 so as not to raise the output voltage higher than the predetermined output voltage. The LEDs 80 can be connected in series to the constant current circuit 96 as shown in FIG. 2, and can be controlled to light with stable brightness characteristics as described in further detail, for example, in Japanese Patent Application Laid Open JP2005-136157 and its English translation, which are hereby incorporated in their entirety by reference.

In the conventional LED lighting apparatus 90 described above, because the inverted boosting circuit 93 is configured by using a charge pump circuit to allow the configuration to be simple, it is difficult to adapt the circuit to high power LEDs such as those used in vehicular lamps (e.g., signal lights, front lights, taillights, stop lights, etc.) When the conventional LED lighting apparatus is used for lighting high power LEDs in a vehicular lamp, for example, use of the constant current circuit 96 can result in some problems like runaway temperature increases (i.e., chip fever), large architecture of the chip, etc., which may result when the current in the device flows from several mil amperes to several amperes in a FET 96*a* and a resistor 96*b* located therein.

Thus, when high power LEDs that are used as a vehicular lamp such as stop lights are lit by the conventional configurative lighting apparatus, a plurality of middle-sized lighting apparatuses can be used for lighting the plurality of LEDs connected in either series or in parallel. In that case, because all of the LEDs are lit by the plurality of middle-sized lighting apparatuses, the conventional configurative lighting apparatuses can result in some problems such as complicated wiring and maintenance, increased cost, etc.

The disclosed subject matter has been devised to consider the above and other problems and characteristics. Thus, an embodiment of the disclosed subject matter can include a LED lighting apparatus for supplying LEDs connected in series with a requisite voltage and power even if the amount of forward voltage of LEDs connected in series is larger than a supply voltage of a battery. The various problems described above are thus addressed and possibly reduced or changed while also addressing and possibly reducing other associated problems.

SUMMARY OF THE DISCLOSED SUBJECT MATTER

The presently disclosed subject matter has been devised in view of the above described characteristics and problems, etc. An aspect of the disclosed subject matter includes a device that has a fail safe function.

According to another aspect of the disclosed subject matter, a LED lighting apparatus can include: a boosting circuit configured to supply power/electricity to an anode of a first LED of LEDs connected in series; a current detection circuit configured to detect a LED current of the LEDs connected in series, the current detection circuit connected between the boosting circuit and the anode of the first LED; an inverted boosting circuit configured to supply power to a cathode of the last LED of the LEDs connected in series; and a dual PWM (pulse-width-modulation) control IC (integrated circuit) with two output terminals and two feedback terminals, one output terminal thereof connected to an input of the boosting circuit and the corresponding feedback terminal thereof connected to an output of the current detection circuit, the other output terminal thereof connected to an input of the inverted boosting circuit and the other corresponding feedback terminal thereof connected to the cathode of the last LED of the LEDs connected in series via resistors if necessary. The dual PWM control IC controls the boosting circuit and the inverted boosting circuit in accordance with the LED current detected by the current detection circuit, so as to keep the LED current substantially constant.

Another aspect of the above described exemplary LED lighting apparatus can include providing a LED lighting apparatus for supplying LEDs connected in series with a requisite voltage and power even if the amount of forward voltage of the LEDs connected in series is larger than a supply voltage of the battery connected thereto. Furthermore, it is also possible to manufacture the apparatus such that it is small in size and incurs a reduced cost.

Another of the aspects of the disclosed subject matter includes a LED lighting apparatus that can include: a shut-down circuit configured to supply the LED lighting apparatus with a power supply or to stop supplying the power supply, as the case may be, wherein the shut down circuit stops supplying the power supply when the current detection circuit detects an over load current in the LED current. The LED lighting apparatus can also include: a voltage detection circuit configured to detect a load voltage, divided detection resistors thereof connecting between the anode of the first LED of the LEDs connected in series and a ground or the cathode of the last LED of the LEDs in series. The voltage detection circuit can be configured to output a signal to the shut down circuit to stop supplying the LED lighting apparatus with power when the voltage detection circuit detects an open circuit at the load that includes the LEDs.

In the immediately above described LED lighting apparatus, the disclosed subject matter can include a fail safe function in order to prevent the LED lighting apparatus from consuming useless power and for preventing damage thereof by a load failure that involves the LEDs, or the like.

BRIEF DESCRIPTION OF THE DRAWINGS

The above and other characteristics and features of the disclosed subject matter will become clear from the following description with reference to the accompanying drawings, wherein.

DETAILED DESCRIPTION OF EXEMPLARY EMBODIMENTS

Exemplary embodiments of the disclosed subject matter will now be described in detail with reference to FIGS. 1*a*-1*b*.

Figure 1A:
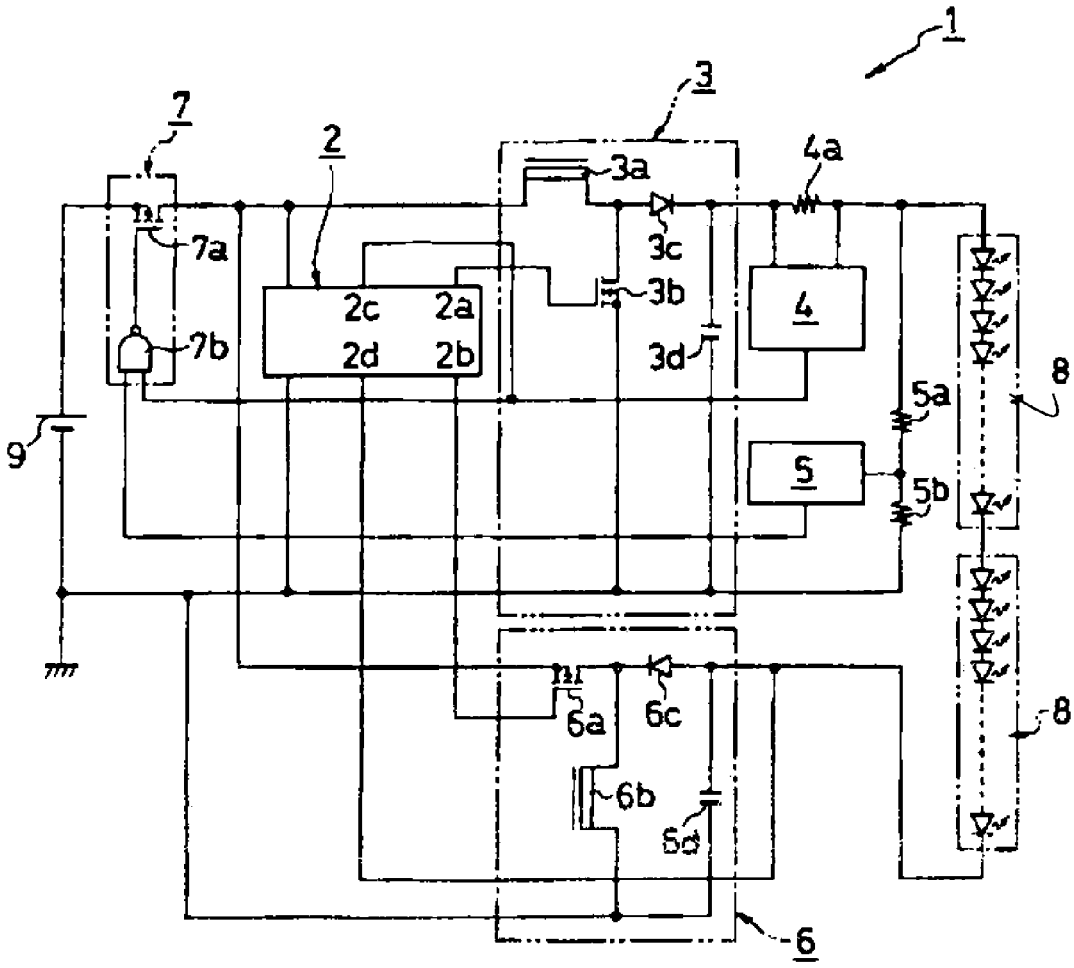
FIG. 1*a* is a block circuit diagram showing an exemplary embodiment of a LED lighting apparatus made in accordance with principles of the disclosed subject matter.

An LED lighting apparatus 1 shown in FIG. 1*a* can include a dual PWM control IC 2 (for example, TL1451A made by Texas Instruments, Inc.); a boosting circuit 3 configured to supply an anode of a first LED of the LEDs 8 that are connected in series with positive polarity electricity; a current detection circuit 4 configured to detect a LED current of the LEDs 8 connected in series, the current detection circuit 4 connecting between the boosting circuit 3 and an anode of the first LED; and an inverted boosting circuit 6 configured to supply a cathode of the last LED of the LEDs 8 with negative polarity electricity. Thus, the LED lighting apparatus 1 provides a simple configuration and enables control of lighting for all LEDs connected in series when the amount of forward voltage of the LEDs is larger than a supply voltage of a battery associated therewith, such as when connected to a vehicle battery.

A specific description of the dual PWM control IC 2 will now be given. The dual PWM control IC 2 can include; dual output circuits with common-emitter transistors; two control circuits for controlling the dual output circuits, respectively; two feedback inputs for receiving feeding back; two error amplifiers to allow feedback thereto; and two dead-time control comparators. The two dead-time control comparators can be configured to have no offset unless externally altered, and can provide 0% to 100% dead time, respectively. Thus, the dual PWM control IC 2 can stably control the dual output circuits for the PWM outputs, respectively.

Figure 2:
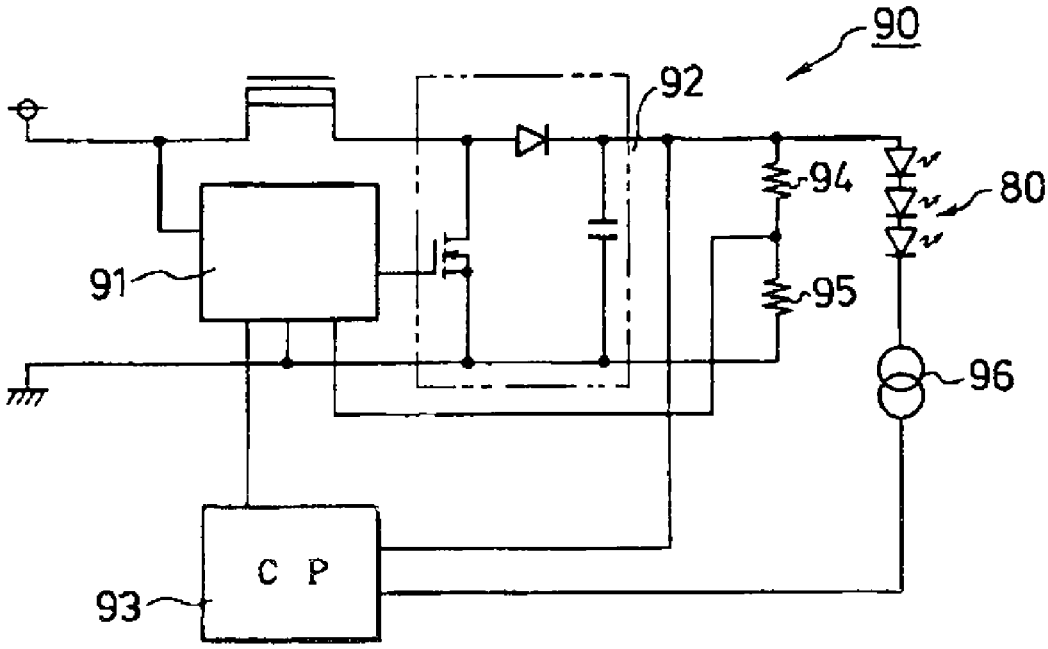
Fig. 2 Conventional Art
FIG. 2 is a block circuit diagram showing a conventional art circuit.
Figure 3:
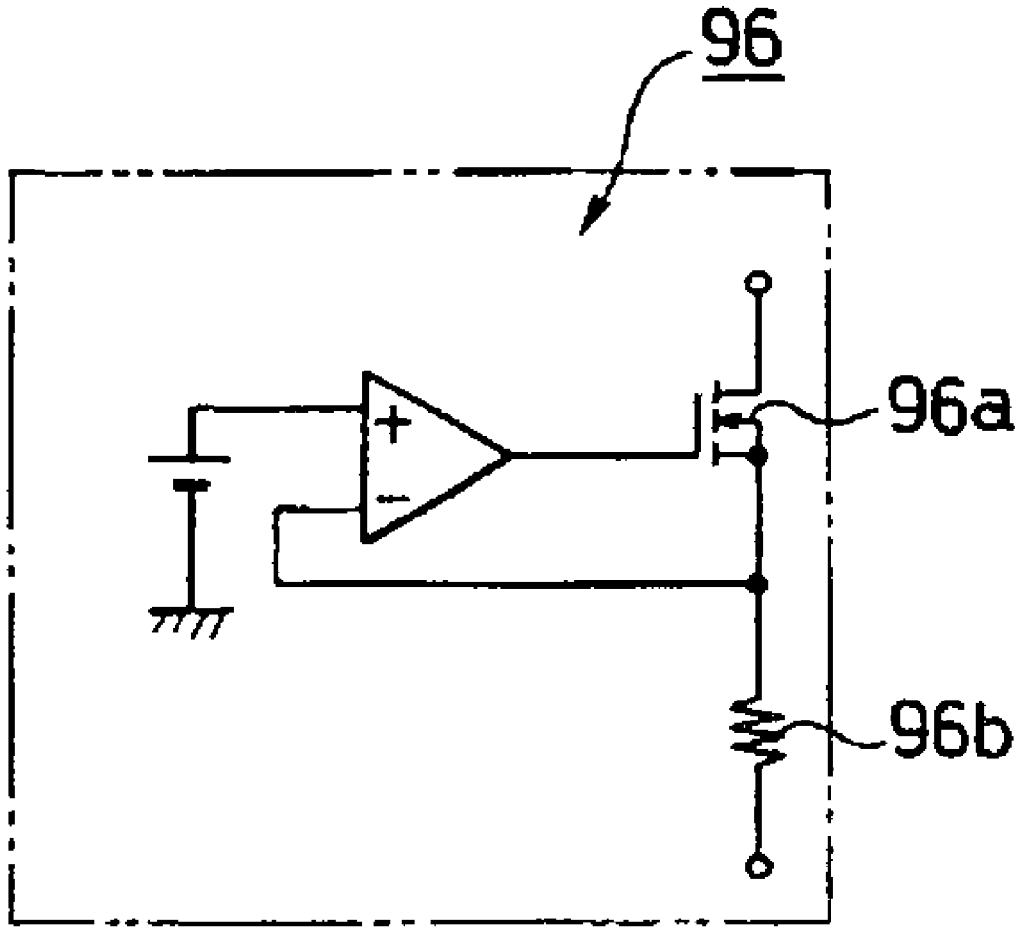
Fig. 3 Conventional Art
FIG. 3 is a circuit diagram showing a constant current circuit in the conventional art circuit shown in FIG. 2.

The boosting circuit 3 can include: an induction coil 3*a*; a FET 3*b* controlled by one output terminal 2*a* of the dual PWM control IC 2; a diode 3*c*; and a capacitor 3*d*. An operational principle of the boosting circuit 3 can be the same as a conventional boosting circuit 92 (a conventional DC-DC converter) as shown in FIG. 2.

A feedback terminal 2*c* corresponding to the output terminal 2*a* of the dual PWM control IC 2 can be connected to an output of the current detection circuit 4 that detects the LED current by measuring a voltage between both ends of a current detection resistor 4*a*. Thus, an output of the boosting circuit 3 can be controlled so as to keep the LED current substantially constant.

The inverted boosting circuit 6 can include: a FET 6*a* controlled by the other output terminal 2*b* of the dual PWM control IC 2; an induction coil 6*b*; a diode 6*c*; and a capacitor 6*d*.

An operational principle of the inverted boosting circuit 6 will now be described. When the FET 6*a* is on, because FET current flows to a ground through the induction coil 6*b* for the diode 6*c* connected in inverted bias, the induction coil 6*b* can be charged with an electric energy. When the FET 6*a* is next in an off state, because a corresponding inverted electricity to the electric energy is generated in the induction coil 6*b* in order to keep charging the electric energy, the capacitor 6*d* can be charged with the inverted electricity through the diode 6*c*. In that case, a positive electrode becomes a ground and a negative electrode becomes an anode of the diode 6*c* in accordance with the direction of charging the electric energy into the capacitor 6*d*. Because the FET 6*a* can alternate the above on and off states by the other output terminal 2*b* of the dual PWM control IC 2, the inverted boosting circuit 6 can be considered an inverted DC-DC converter against a power supply 9 to allow output of a negative DC voltage from the anode of the diode 6*c*.

When the anode of the first LED of the LEDs 8 that are connected in series is connected to the positive output of the boosting circuit 3 through the current detection resistor 4*a*, and the cathode of the last LED of the LEDs 8 is connected to the negative output of the inverted boosting circuit 6 that is biased with a minus potential, the LEDs 8 connected in series can be connected between a high voltage having a voltage that is approximately double the voltage of the DC-DC converter output of the boosting circuit 3. The LED current can be constant by controlling at least one output voltage of the boosting circuit 3 and the inverted boosting circuit 6 by using the dual PWM control IC 2.

A fail safe function will be now described as another aspect of the disclosed subject matter. The current detection circuit 4 can detect a breakdown such as a short circuit of a load that includes the LEDs 8 by detecting a current that is larger than a predetermined current. In that case, a shut down circuit 7 can stop supplying the LED lighting apparatus via the power supply 9 by turning off a FET 7*a* through the use of an output of the current detection circuit 4. Thus, the current detection circuit 4 can include a fail safe function in order to prevent the LED lighting apparatus from consuming useless power and in order to prevent various other breakdowns due to over current in the circuit.

The current detection circuit 4 can also detect a load failure by detecting a current that is smaller than a predetermined current. However, it is difficult for the current detection circuit 4 to detect a very small current such as when an open circuit of a load occurs, because an open circuit of a load may be suddenly generated. In that case, at least one output voltage of the boosting circuit 3 and the inverted boosting circuit 6 may suddenly increase in order to suddenly cause the LED current to decrease. A voltage detection circuit 5 can easily detect the open circuit of a load by measuring a voltage between divided resistors 5*a* and 5*b*. These resistors 5*a* and 5*b* are connected between the anode of the first LED and a ground as shown in FIG. 1*a*. However, theses resistors 5*a* and 5*b* can be connected between the anode of the first LED and the cathode of the last LED by arranging the resistors accordingly. The voltage detection circuit 5 can also control the shutdown circuit 7 by using an output signal thereof. For example, when the voltage detection circuit 5 detects an open circuit of a load that includes the LEDs 8, the voltage detection circuit 5 can control the shut down circuit 7 so as not to suddenly increase the outputs of the boosting circuit 3 and the inverted boosting circuit 6.

Thus, when the current detection circuit 4 outputs a signal corresponding to a short circuit of the load that includes LEDs 8, or when the voltage detection circuit 5 outputs a signal corresponding to an open circuit of the load including the LEDs 8, the power supply 9 to the LED lighting apparatus can be stopped by the FET 7*a* in the shutdown circuit 7.

As described above, the above exemplary embodiment can detect a short circuit of a load by one current detection circuit and also can detect an open circuit of a load by one voltage detection circuit, because the LEDs can be connected in series. In the conventional lighting apparatus, both the number of current detection circuits and voltage detection circuits are limited by the number of LEDs. Furthermore, because circuits in the above exemplary embodiment can be divided between those that connect positive voltage to a ground and those that connect a ground to the negative voltage, the absolute maximum rating for the FET 3*b*, 3*a*, diode 3*c*, 6*c*, capacitor 3*d*, 6*d* and other electronic components, etc., used in the above exemplary embodiment can be the same as that of conventional lighting apparatus.

Figure 1B:
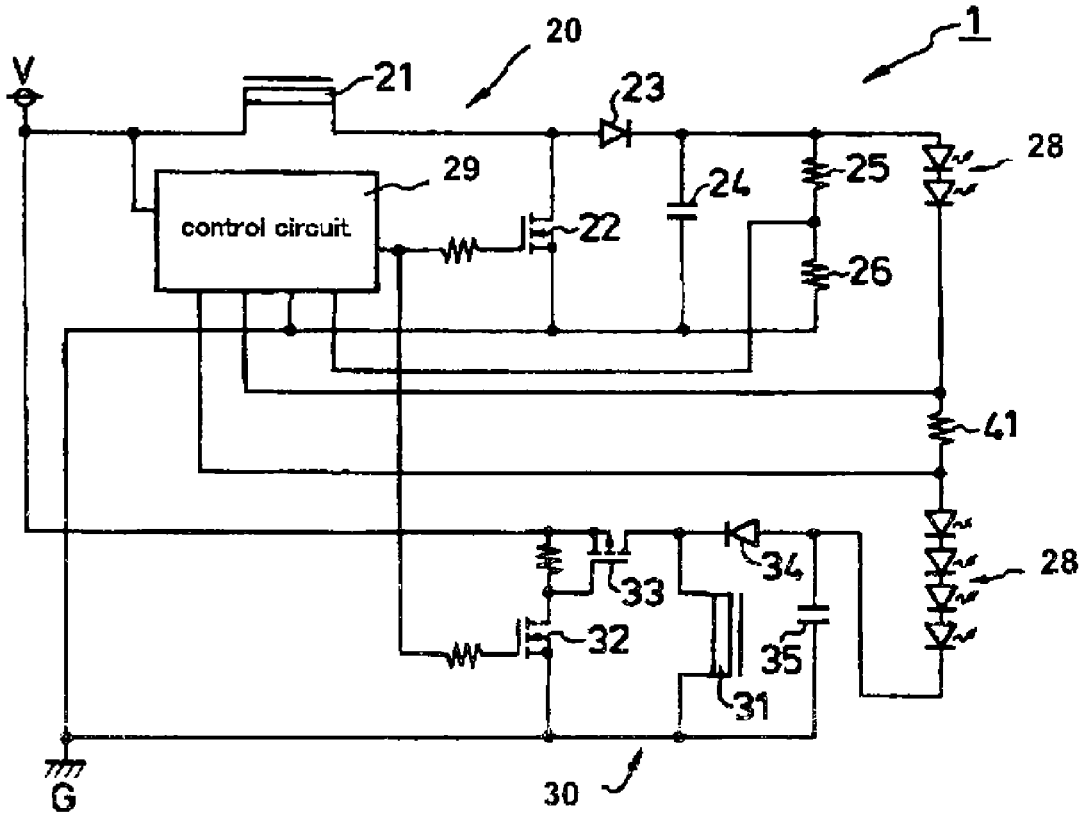
FIG. 1*b* is a block circuit diagram showing another exemplary embodiment of a LED lighting apparatus made in accordance with principles of the disclosed subject matter.

As shown in FIG. 1*b*, another embodiment of a LED lighting apparatus 1 can include a control circuit 29 in place of the dual PWM control IC 2, the current detection circuit 4 and the voltage detection circuit 5 of FIG. 1*a*. A boosting circuit 20 can be configured to supply positive current to an anode of a first of the LEDs 28 connected in series. An inverted boosting circuit 30 can be configured to supply a negative current to a cathode of the last of the LEDs 28. The LED lighting apparatus 1 of FIG. 1*b* also has a simple configuration and enables control of lighting for all LEDs connected in series when the amount of forward voltage of the LEDs is larger than a supply voltage of a battery associated therewith, such as a vehicle battery.

The inverted boosting circuit 30 can include two FETs 32 and 33 that are connected in series with a diode 34 and connected in parallel with an induction coil 31 and separately in parallel with a capacitor 35.

The boosting circuit 20 can include a FET 22 connected in parallel with a diode 23 and a capacitor 24 and in series with an induction coil 21.

Two resistors 25 and 26 can be connected in parallel with the LEDs 28 while separately connected to terminals of the control circuit 29. In addition, a resistor 41 can be placed between sets of the LEDs 28 with connections to separate terminals of the control circuit 29, both before and after the resistor 41.

In operation, the embodiment of FIG. 1*b* can be configured to act substantially similar to the embodiment of FIG. 1*a*.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. An LED lighting apparatus comprising:

a plurality of LEDs connected in series including a first LED and a last LED, the first LED including an anode and a cathode, and the last LED including an anode and a cathode;

a boosting circuit configured to supply electricity to the anode of the first LED;

a current detection circuit configured to detect a LED current of the plurality of LEDs connected in series, the current detection circuit connected between the boosting circuit and the anode of the first LED;

an inverted boosting circuit configured to supply electricity to the cathode of the last LED; and a dual PWM control IC with two output terminals and two feedback terminals, a first output terminal of the two output terminals connected to an input of the boosting circuit, and a corresponding feedback terminal of the two feedback terminals connected to an output of the current detection circuit, the other output terminal of the two output terminals connected to an input of the inverted boosting circuit, and a corresponding second feedback terminal of the two feedback terminals connected to an output of the inverted boosting circuit, wherein the dual PWM control IC is configured to control the boosting circuit and the inverted boosting circuit in accordance with the LED current detected by the current detection circuit, such that the LED current is substantially constant during operation of the apparatus.

2. The LED lighting apparatus according to claim 1, further comprising:

a shutdown circuit configured to selectively supply power from a power supply connected to the shutdown circuit and stop supplying power from the power supply connected to the shutdown circuit, wherein the shutdown circuit is configured to stop supplying power from the power supply when the current detection circuit detects an over load current across the plurality of LEDs.

3. The LED lighting apparatus according to claim 2, further comprising:

a voltage detection circuit configured to detect a load voltage, the voltage detecting circuit includes divided detection resistors connected between the anode of the first LED and at least one of a ground and the cathode of the last LED, and wherein the voltage detection circuit is configured to output a signal to the shutdown circuit to cause the shutdown circuit to stop supplying power when the voltage detection circuit detects an open circuit of a load that includes the LEDs connected in series.

4. The LED lighting apparatus according to claim 1, wherein the LEDs connected in series are configured as a light source for a vehicular lamp.

5. The LED lighting apparatus according to claim 2, wherein the LEDs connected in series are configured as a light source for a vehicular lamp.

6. The LED lighting apparatus according to claim 3, wherein the LEDs connected in series are configured as a light source for a vehicular lamp.

7. The LED lighting apparatus according to claim 1, wherein the dual PWM control IC, the current detection circuit, and the voltage detection circuit are configured as a microprocessor having an analog to digital converter.

* * * * *